US009133619B1

(12) United States Patent
Roberts et al.

(10) Patent No.: US 9,133,619 B1
(45) Date of Patent: Sep. 15, 2015

(54) ARCHITECTURAL BUILDING BLOCK

(71) Applicants: Peter A. Roberts, Alfred Station, NY (US); Dillon D. Jones, Silver Creek, NY (US); Stephen R. LiVoti, Oswego, NY (US); Corey J. Bergendahl, Kings Park, NY (US); Jacob D. Brown, Emporium, PA (US); Andrew M. Schermerhorn, Lockport, NY (US)

(72) Inventors: Peter A. Roberts, Alfred Station, NY (US); Dillon D. Jones, Silver Creek, NY (US); Stephen R. LiVoti, Oswego, NY (US); Corey J. Bergendahl, Kings Park, NY (US); Jacob D. Brown, Emporium, PA (US); Andrew M. Schermerhorn, Lockport, NY (US)

(73) Assignee: Spherical Block LLC, Alfred Station, NY (US)

( * ) Notice: Subject to any disclaimer, the term of this patent is extended or adjusted under 35 U.S.C. 154(b) by 0 days.

(21) Appl. No.: 14/548,546

(22) Filed: Nov. 20, 2014

(51) Int. Cl.
*E04C 2/04* (2006.01)
*E04C 1/00* (2006.01)
*E04B 1/02* (2006.01)

(52) U.S. Cl.
CPC .... *E04C 1/00* (2013.01); *E04B 1/02* (2013.01)

(58) Field of Classification Search
CPC ..... E04B 2/08; E04B 2/12; E04B 2/18; E04B 2/22; E04B 2/44; E04C 1/00; E04C 1/397
See application file for complete search history.

(56) References Cited

U.S. PATENT DOCUMENTS 1,072,293 A * 9/1913 Zeimet ..... 52/206
1,606,150 A * 11/1926 Curtis ..... 52/506.03
2,114,244 A * 4/1938 Zoettl ..... 52/100
2,141,397 A * 12/1938 Locke ..... 52/204.2
2,184,682 A * 12/1939 Sentrop ..... 52/275
2,206,205 A * 7/1940 Selby ..... 52/575
2,308,790 A * 1/1943 Stagg ..... 52/550
2,392,551 A * 1/1946 Roe ..... 52/586.2
2,736,188 A * 2/1956 Wilhelm ..... 52/560
2,861,388 A * 11/1958 Favaretto ..... 446/124
3,717,967 A * 2/1973 Wood ..... 52/259
3,822,569 A * 7/1974 Lautrup-Larsen ..... 446/85
3,962,842 A * 6/1976 Wilhelm ..... 52/436
3,968,615 A * 7/1976 Ivany ..... 52/439
4,015,391 A * 4/1977 Epstein et al. ..... 52/520
4,075,808 A * 2/1978 Pearlman ..... 52/439
4,167,840 A * 9/1979 Ivany ..... 52/438
4,320,606 A * 3/1982 GangaRao ..... 52/125.5
4,597,236 A * 7/1986 Braxton ..... 52/564
4,643,427 A * 2/1987 Wozniak ..... 273/160
4,726,567 A * 2/1988 Greenberg ..... 256/19
5,365,714 A * 11/1994 Potvin ..... 52/590.2
5,507,127 A * 4/1996 Gates ..... 52/605
5,711,130 A * 1/1998 Shatley ..... 52/604
6,065,265 A * 5/2000 Stenekes ..... 52/607
6,082,067 A * 7/2000 Bott ..... 52/592.3

(Continued)

FOREIGN PATENT DOCUMENTS

WO WO 2012104685 A1 * 8/2012

*Primary Examiner* — Mark Wendell
*Assistant Examiner* — Keith Minter
(74) *Attorney, Agent, or Firm* — Tracy Jong Law Firm; Tracy P. Jong; Cheng Ning Jong

(57) ABSTRACT

An architectural building block including a front terminal wall, a rear terminal wall disposed substantially parallel to the front terminal wall, a pair of side walls adjoining the front terminal wall and the rear terminal wall, a top wall and a bottom wall. The side walls lean toward one another. The pair of side walls converge from the rear terminal wall to the front terminal wall. The bottom wall is disposed substantially parallel to the top wall, wherein each of the top wall and bottom wall adjoins the front terminal wall, the rear terminal wall and the pair of side walls.

20 Claims, 18 Drawing Sheets

(56) References Cited

U.S. PATENT DOCUMENTS

| | | | | |
|---|---|---|---|---|
| 6,098,357 | A * | 8/2000 | Franklin et al. | 52/223.7 |
| 6,226,951 | B1 * | 5/2001 | Azar | 52/604 |
| 6,244,009 | B1 * | 6/2001 | Cerrato | 52/604 |
| D464,441 | S * | 10/2002 | Luaces | D25/114 |
| 6,588,168 | B2 * | 7/2003 | Walters | 52/604 |
| 6,735,913 | B2 * | 5/2004 | Sanders et al. | 52/284 |
| 7,007,436 | B1 * | 3/2006 | Kelley | 52/605 |
| 7,117,647 | B2 * | 10/2006 | Clarke | 52/233 |
| 7,461,490 | B2 * | 12/2008 | Toledo | 52/605 |
| 7,584,584 | B2 * | 9/2009 | Fennell, Jr. | 52/607 |
| 7,882,674 | B2 * | 2/2011 | Craven et al. | 52/606 |
| 8,061,095 | B2 * | 11/2011 | Bucheger | 52/223.7 |
| 8,266,855 | B1 * | 9/2012 | Altararwah | 52/284 |
| 8,464,482 | B2 * | 6/2013 | Raynor | 52/296 |
| 8,667,760 | B2 * | 3/2014 | Drew | 52/600 |
| 2002/0021042 | A1 * | 2/2002 | Damron | 299/12 |
| 2002/0043038 | A1 * | 4/2002 | Cerrato | 52/604 |
| 2003/0070386 | A1 * | 4/2003 | Hampton | 52/606 |
| 2003/0070388 | A1 * | 4/2003 | Catani et al. | 52/677 |
| 2004/0020145 | A1 * | 2/2004 | Matsufuji | 52/223.7 |
| 2005/0102950 | A1 * | 5/2005 | Knudson et al. | 52/596 |
| 2005/0108972 | A1 * | 5/2005 | Banova | 52/596 |
| 2005/0115185 | A1 * | 6/2005 | Telford et al. | 52/596 |
| 2005/0252118 | A1 * | 11/2005 | Matsufuji | 52/223.7 |
| 2005/0284077 | A1 * | 12/2005 | Spratlen et al. | 52/606 |
| 2006/0000179 | A1 * | 1/2006 | Albert | 52/606 |
| 2006/0059839 | A1 * | 3/2006 | Azar | 52/606 |
| 2006/0168907 | A1 * | 8/2006 | Thorpe | 52/309.12 |
| 2007/0056235 | A1 * | 3/2007 | Kohler | 52/223.7 |
| 2007/0107364 | A1 * | 5/2007 | Estes et al. | 52/606 |
| 2007/0245673 | A1 * | 10/2007 | Cerrato | 52/607 |
| 2008/0047219 | A1 * | 2/2008 | Donohew | 52/603 |
| 2008/0120931 | A1 * | 5/2008 | Joslyn | 52/293.3 |
| 2009/0025333 | A1 * | 1/2009 | Moroschan | 52/742.13 |
| 2009/0188186 | A1 * | 7/2009 | Ebanks | 52/253 |
| 2009/0235606 | A1 * | 9/2009 | Ness et al. | 52/596 |
| 2010/0043335 | A1 * | 2/2010 | O'Connor | 52/592.6 |
| 2011/0247289 | A1 * | 10/2011 | Schmidt | 52/561 |
| 2013/0205705 | A1 | 8/2013 | Bilka | |
| 2013/0276400 | A1 * | 10/2013 | Genest et al. | 52/600 |
| 2013/0333313 | A1 * | 12/2013 | Alsayed et al. | 52/220.1 |
| 2014/0053493 | A1 * | 2/2014 | Carey | 52/604 |
| 2014/0223848 | A1 * | 8/2014 | Binhussain et al. | 52/309.17 |

* cited by examiner

ARCHITECTURAL BUILDING BLOCK

BACKGROUND OF THE INVENTION

1. The Field of the Invention

The present invention is directed generally to architectural building blocks for constructing cylinders and arches. More specifically, the present invention is directed to masonry architectural building blocks for constructing cylinders and arches.

2. Background Art

In fabricating structures composed of curvilinear parts, typically forms are required for concrete pouring as conventional blocks are often unsuitable for constructing such parts as conventional masonry blocks are unsuitable due to their shapes and sizes. On-site constructions of structures using forms often involve significant custom architectural and engineering preparation work, which not only increases the construction cost but also the lead time in completing the construction projects. Even if conventional masonry blocks are used to construct curvilinear parts, sufficient skills are required to custom shape some masonry blocks so that they can fit in with other unmodified blocks to approximate the structural shape to be constructed. Conventional blocks used for curvilinear parts include rectangular and triangular blocks, etc. In many occasions, sufficient skills may also be required to adjust the amount of mortar used between blocks such that curvilinear parts can be constructed. When built without forms or other supporting structures, the use of conventional blocks does not yield uniform, accurate and repeatable arch structures. It may even be impossible to construct a curvilinear structure using conventional blocks if mortar had not been used.

U.S. Pat. No. 2,392,551 to Roe (hereinafter Roe) discloses a wall structure having a series of superposed courses of building blocks, matching keyways in certain adjacent blocks in a course and keys in the keyways locking the adjacent blocks together. Each of the keys extends from one course into and fits snugly within an opening in a block of an adjacent course, thereby locking adjacent courses together against horizontal shifting, and tongue and groove connections inclined to the longitudinal axes of the keys and interlocking blocks of adjacent courses whereby the first named keys and the tongue and groove connections lock the courses against vertical as well as horizontal shifting, the tongues of the tongue and groove connections being each integral with a block. Although a means for interlocking adjacently disposed blocks is provided, Roe fails to disclose building blocks useful for building arches when used in conjunction with only two rebars.

U.S. Pat. Pub. No. 2013/0205705 of Bilka (hereinafter Bilka) discloses a masonry article having one or more sidewalls, top and bottom, and first and second ends configured with a horizontal and vertical locking mechanism, wherein top and bottom includes first axis locking mechanism, wherein the top surface is formed with at least one stepped section having a base that begins with a level footing and the bottom opposite surface formed with at least one other stepped section having a base that begins with a level footing to releasably receive one of the top, and wherein first and second ends include contoured receptacles to releasably receive a matching configured link block having opposite male contour surface to form second axis locking mechanism. Similar to Roe, Bilka fails to disclose building blocks useful for building arches when used in conjunction with only two rebars. Instead, Bilka discloses blocks useful for building cylindrical structures although such structures of Bilka do not contain corrugations and/or ribs that are capable of further resisting against external loading, impacts, high winds, seismic forces, etc.

Thus, there is a need for blocks useful for constructing arches and cylinders that are capable of resisting environmental forces and ones which can be built without using prefabricated or in-situ built forms and temporary support structures or scaffolding systems.

SUMMARY OF THE INVENTION

In accordance with the present invention, there is provided an architectural building block including:

(a) a front terminal wall having a top edge and a bottom edge;

(b) a rear terminal wall having a top edge and a bottom edge, the rear terminal wall is disposed substantially parallel to the front terminal wall, wherein both the front terminal wall and the rear terminal wall define the longitudinal ends of the architectural building block, the width of the top edge of the front terminal wall is less than the width of the top edge of the rear terminal wall and the width of the bottom edge of the front terminal wall is less than the width of the bottom edge of the rear terminal wall;

(c) a pair of side walls adjoining the front terminal wall and the rear terminal wall, wherein the side walls lean toward one another, the pair of side walls converge from the rear terminal wall to the front terminal wall; and (d) a top wall and a bottom wall, the bottom wall is disposed substantially parallel to the top wall, wherein each of the top wall and bottom wall adjoins the front terminal wall, the rear terminal wall and the pair of side walls, wherein at least one side wall is configured to be positionable so as to mate with a side wall of an adjacently disposed block, whereby curved structures may be constructed from a plurality of such blocks.

In one embodiment, the present block further includes two channels, wherein each of the side walls further includes two halves, each channel extending from one of the side walls to the other one of the side walls, each of the two channels having a width adapted to enable traversal of a rebar and a center having a central axis that is substantially centrally disposed within one of the two halves.

In one embodiment, each of the two channels includes an opening having an outward taper of from about 1 degree to about 5 degrees on each wall of the two channels.

In one embodiment, at least one channel includes an opening through the top wall.

In one embodiment, at least one channel includes an opening through the bottom wall.

The present block may be constructed from concrete, cinders, vitrified ceramic, glass, plastic, wood pulp, cardboard, fiberglass, epoxy composite, metal, construction foam, tamped earth, boron, borides, and any combinations thereof.

In one embodiment, each side wall further includes two halves, one adjacent the front terminal wall and another adjacent the rear terminal wall. Each half includes a depression and a protrusion. The depression is configured in a shape complementary to the protrusion such that when the depression of one block may be mated with the protrusion of an adjacently disposed block.

In one embodiment, the block further includes an orientation marker biasly disposed along the longitudinal direction of the block. In one embodiment, the orientation marker is disposed on a surface of one of the two channels, thereby removing the need for disposing the orientation marker on one of the front and rear terminal walls, the top and bottom walls and the pair of side walls.

An object of the present invention is to provide a block capable of assembly with similar blocks to form arches and cylinders.

Another object of the present invention is to provide a block capable of assembly with similar blocks to form corrugated and/or ribbed structures.

Another object of the present invention is to provide a block capable for use with one or more rebars.

Another object of the present invention is to provide a block that is of lighter weight than a conventional similarly dimensioned block.

Another object of the present invention is to provide a block capable of assembly with similar blocks to form structures having a high-strength axis aligned with the direction in which environmental and man-made forces are applied.

Another object of the present invention is to provide a block capable of assembly with similar blocks with or without mortar.

Another object of the present invention is to provide a block capable of assembly with similar blocks with interlocking features.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
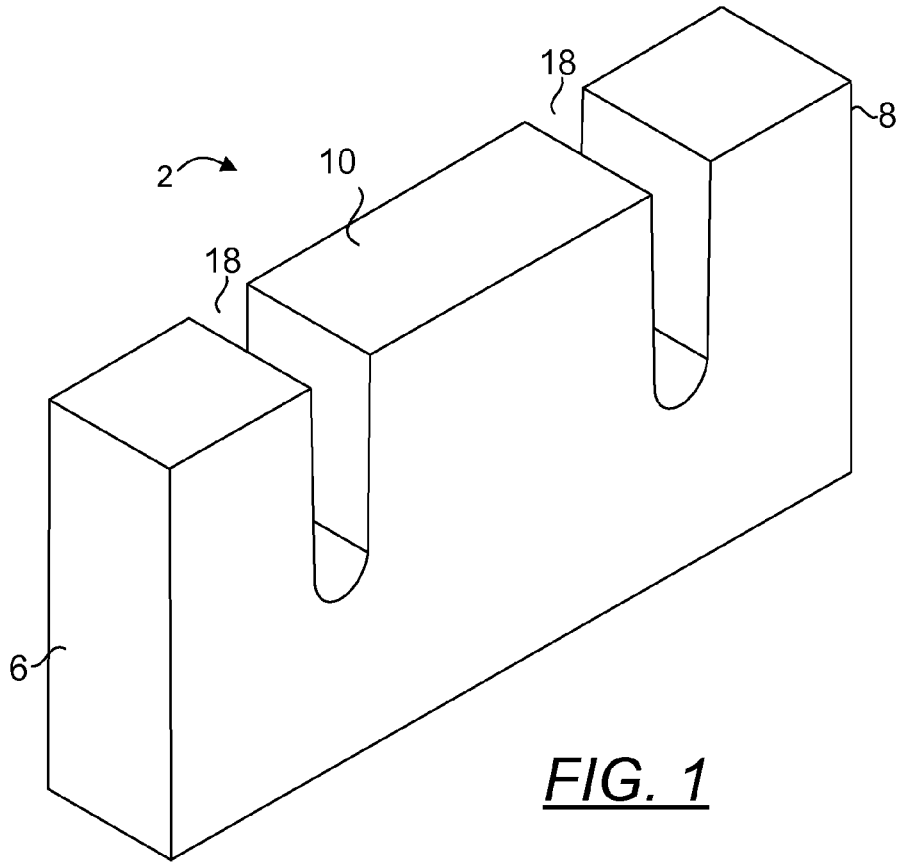
FIG. 1 is a top front perspective view of a block.

2—architectural building block
4—side wall
6—front terminal wall
8—rear terminal wall
10—top wall
12—bottom wall
14—reinforcement bar or rebar
16—orientation marker
18—channel
20—length of block
22—half of the length of half a block
24—width of bottom edge of front terminal wall
26—width of top edge of front terminal wall
28—width of bottom edge of rear terminal wall
29—width of top edge of rear terminal wall
30—height of block
32—central axis of channel
34—top edge of block
36—half of a block
38—length of a half of a block
40—outward taper
42—protrusion
44—depression
46—gasket
48—angle
50—span of arch
52—height of protrusion or depth of depression
54—half of height of block

PARTICULAR ADVANTAGES OF THE INVENTION

A plurality of the present blocks can be used to build right circular cylinders and cylindrical sections, e.g., arches and arches with more than one center, e.g., 'vesica piscis' or gothic arches, etc. As such, this provides extensive design flexibility in the types of structures that may result from such blocks.

Structures, e.g., cylinders and arches, that are formed as a result of the use of the present blocks include corrugations and/or ribs, resulting in greater flexural rigidity and overall strength in the structures. Such structures present greater resistance to external loading, impacts, high winds, seismic forces, etc.

In embodiments of the present blocks having two channels, rebars can be readily used in conjunction with these blocks as the channels serve to locate the blocks around the rebars. In addition, rebars and the present blocks may be arranged in a manner which creates corrugations of the assembled structure. As an example, a rebar may be bent into a curved shape and erected so as to serve as a foundation upon which blocks may be installed. The radius of curvature of the rebar is the radius of the arch. If concrete blocks and steel rebars are used, the assembled structure will possess the high strength of steel reinforced concrete.

As the structures built using the present blocks include corrugations and the individual blocks themselves can include channels, the individual blocks are easier to handle and the assemblies built using the blocks are lighter. Although additional mortar may be used to fill the gaps in the corrugations upon assembling the blocks, the ability to form a structure which can readily receive mortar makes the application of mortar easier and faster as mortar may be sprayed on the structure without concerns of the proper spacing of blocks using mortar and ability of mortar in holding two blocks together. Mortar may also be applied individually on each block while it is being added one-at-a time to an assembly.

In one embodiment, the present blocks are dimensioned to correspond to the modular coordination of design used in U.S. construction, where all materials are based on 4 inch cubic grid. In one embodiment, the present blocks are 8 inches by 16 inches (similar to the ubiquitous concrete blocks used in the U.S. Construction industry). These dimensions allow for a maximum number of blocks to be made per cycle on an existing block machine; a feature which is very important to mold life and throughput for a block manufacturer. This high throughput results in low cost and high performance structures.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Disclosed herein are embodiments of an architectural building block. The architectural building block includes a front terminal wall, a rear terminal wall, a pair of side walls, a top wall and a bottom wall.

Figure 2:
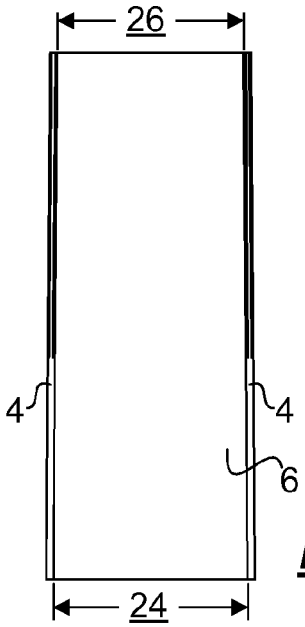
FIG. 2 is a front elevational view of a block.
Figure 3:
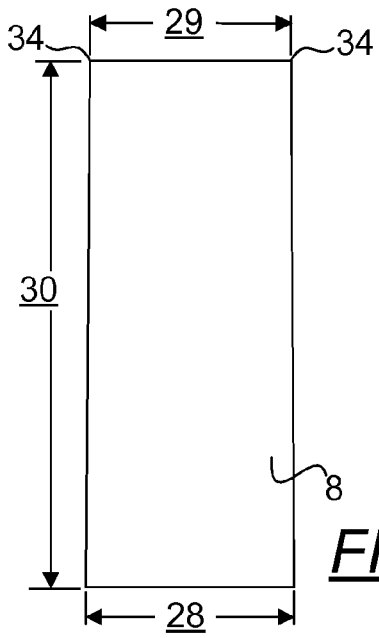
FIG. 3 is a rear elevational view of a block.
Figure 4:
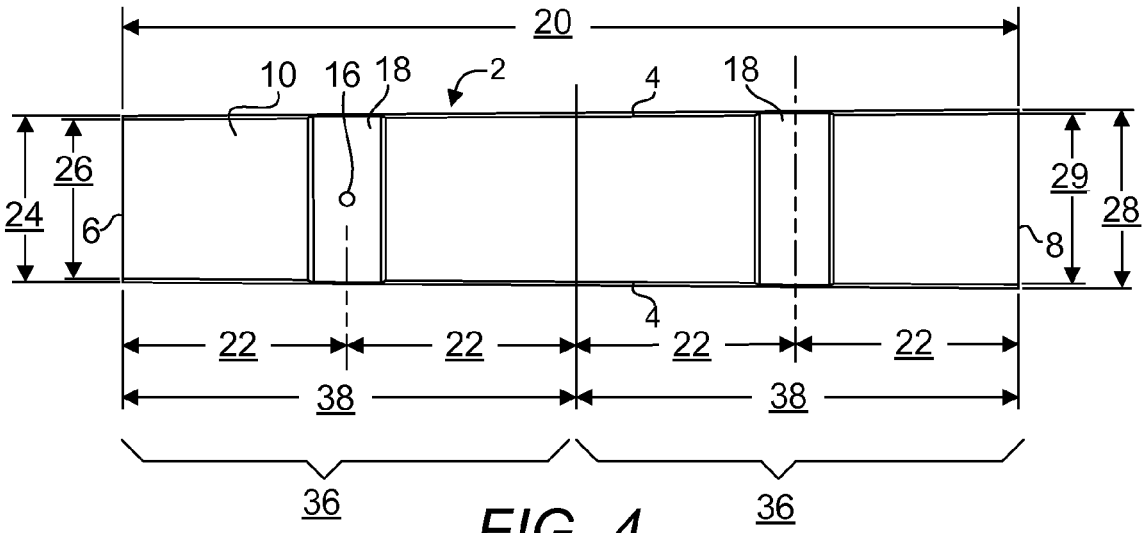
FIG. 4 is a plan view of a block.
Figure 5:
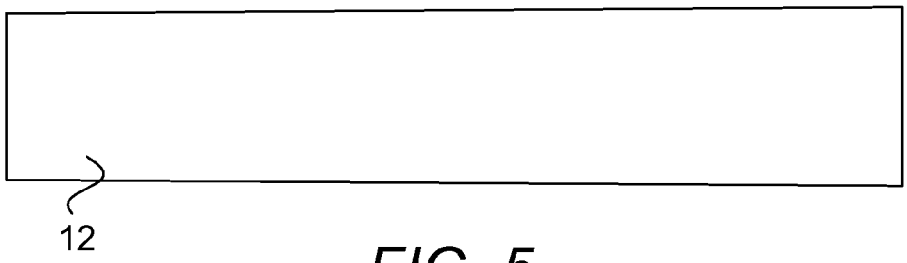
FIG. 5 is a bottom view of a block.

FIG. 1 is a top front perspective view of a block. FIG. 2 is a front elevational view of a block. FIG. 3 is a rear elevational view of a block. FIG. 4 is a plan view of a block. FIG. 5 is a bottom view of a block. The rear terminal wall 8 is disposed substantially parallel to the front terminal wall 6, where both the front terminal wall 6 and the rear terminal wall 8 define the longitudinal ends of the architectural building block 2. The pair of side walls 4 adjoins the front terminal wall 6 and the rear terminal wall 8. The side walls 4 lean toward one another. Referring to FIGS. 4 and 5, it shall be noted that the pair of side walls 4 converge from the rear terminal wall 8 to the front terminal wall 6. For clarity, the rear end of the block is referred to as the "thick side" as it is dimensionally more prominent than the front end of block that is referred to as the "thin side" as the block tapers from the rear end to the front end. The bottom wall 12 is disposed substantially parallel to the top wall 10, where each of the top wall 10 and bottom wall 12 adjoins the front terminal wall 6, the rear terminal wall 8 and the pair of side walls 4. As the length 20 of the block 2 is about 16 inches and the height 30 of the block 2 is about 8 inches, the block 2 satisfies the 4 inch cubic grid system. The width of the block 2, on average, is about 3 inches. Note that the widths of the top edge and bottom edge of the front and rear terminal walls are unique. The average width is defined as the average of the widths of the top edge and bottom edge of the front and rear terminal walls or dimensions 26, 24, 29 and 28. When constructed from concrete, a current block 2 weighs about 28 lbs. A conventional cinder block weighs about 35 lbs in comparison. The present block is therefore lighter weight and easier to handle than a conventional cinder block.

Each side wall 4 further includes two halves 36, both having identical lengths 38. In one embodiment, the block further includes two channels 18. Each channel 18 extends from one side wall 4 to the other side wall 4. Each channel 18 includes a width adapted to enable traversal of a rebar and a central axis 32 that is substantially centrally disposed within one of the two halves 36. In one embodiment, a block further includes an orientation marker biasly disposed along the longitudinal direction of the block 2. In one embodiment, the orientation marker 16 is disposed on a surface of one of the two channels 18, thereby removing the need for disposing the orientation marker 16 on one of the front and rear terminal walls 6,8, the top and bottom walls and the pair of side walls 4, making a block more aesthetically pleasing and the exposed surfaces featureless. In one embodiment, the orientation marker 16 is a circle. Referring to FIG. 4, the orientation marker 16 is disposed at the center of the channel closer to the front terminal wall. The orientation marker 16 may alternatively be disposed at the center of the channel 18 closer to the rear terminal wall. An orientation marker aids a user in recognizing one end of the block from the other end of the block. In the embodiment shown, as the orientation marker 16 is associated with the front end of the block (as the orientation marker is disposed on a surface of the channel 18 that is closer to this end), the user who picks up a block simply needs to glance at this orientation marker to quickly identify the orientation of the block to avoid errors in installing the block onto rebars. Orientation markers are important to the user especially for blocks that are dimensioned with the thick side only subtly thicker than the thin side.

In one embodiment, the ratio of the width 26 of the top edge of the front terminal wall to the width 24 of the bottom edge of the front terminal wall is about 0.82 and the ratio of the width 29 of the top edge of the rear terminal wall to the width 28 of the rear terminal wall is about 0.87. In this embodiment, an arch constructed from blocks having such dimensions may span about 10 ft. Therefore, referring to FIG. 21, with the critical dimensions, e.g., width, height and length of each block disclosed elsewhere herein and the dimensions of the front and rear terminal walls, an arch having a span 50 of 10 ft. can be constructed.

In another embodiment, the ratio of the width 26 of the top edge of the front terminal wall to the width 24 of the bottom edge of the front terminal wall is about 0.88 and the ratio of the width 29 of the top edge of the rear terminal wall to the width 28 of the rear terminal wall is about 0.90. In this embodiment, an arch constructed from blocks having such dimensions may span about 15 ft.

In yet another embodiment, the ratio of the width 26 of the top edge of the front terminal wall to the width 24 of the bottom edge of the front terminal wall is about 0.91 and the ratio of the width 29 of the top edge of the rear terminal wall to the width 28 of the rear terminal wall is about 0.92. In this embodiment, an arch constructed from blocks having such dimensions may span about 20 ft.

In yet another embodiment, the ratio of the width 26 of the top edge of the front terminal wall to the width 24 of the bottom edge of the front terminal wall is about 0.93 and the ratio of the width 29 of the top edge of the rear terminal wall to the width 28 of the rear terminal wall is about 0.94. In this embodiment, an arch constructed from blocks having such dimensions may span about 25 ft.

In yet another embodiment, the ratio of the width 26 of the top edge of the front terminal wall to the width 24 of the bottom edge of the front terminal wall is about 0.95 and the ratio of the width 29 of the top edge of the rear terminal wall to the width 28 of the rear terminal wall is about 0.96. In this embodiment, an arch constructed from blocks having such dimensions may span about 40 ft.

Figure 6:
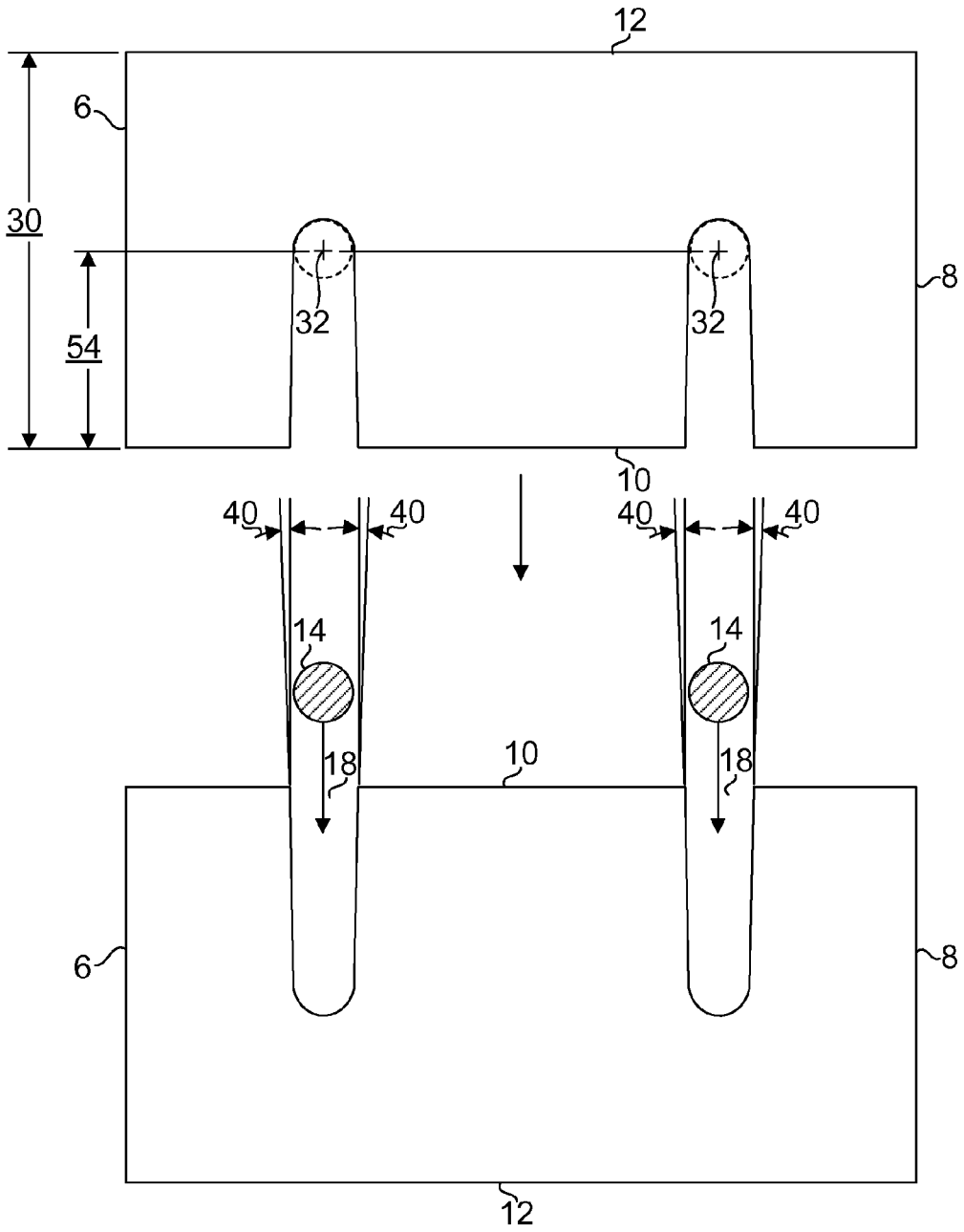
FIG. 6 is a diagram depicting a process of assembling two blocks onto two rebars.
Figure 7:
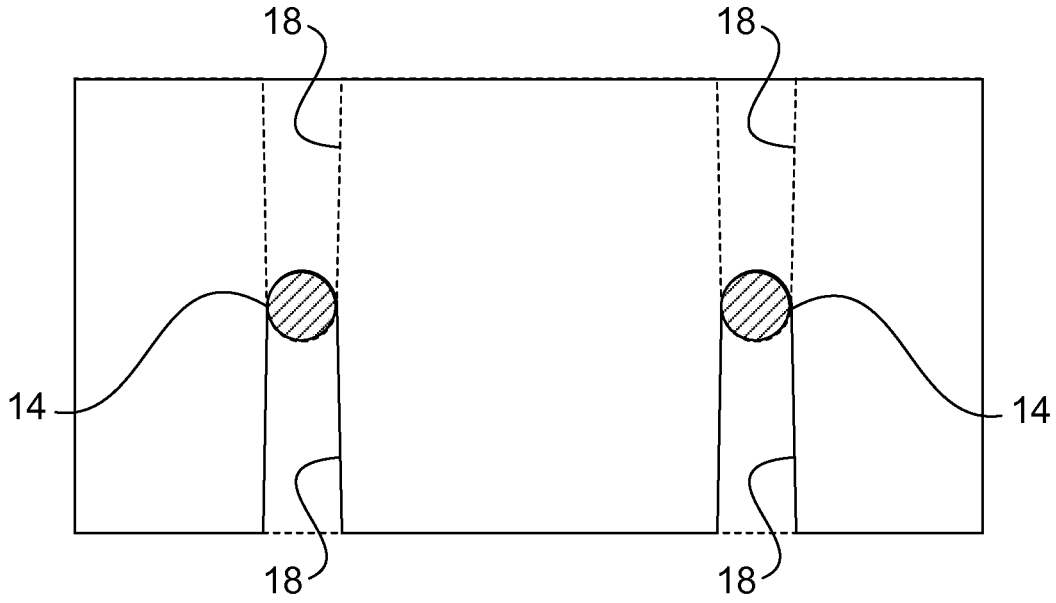
FIG. 7 is a diagram depicting the result of having assembled two blocks onto two rebars.

FIG. 6 is a diagram depicting a process of assembling two blocks 2 onto two rebars 14. FIG. 7 is a diagram depicting the result of having assembled two blocks 2 onto two rebars 14 to form a two-course structure. The obscured block is represented by dotted lines. It shall be noted that the blocks can be installed on rebars 14 from any one of the two directions, provided that each channel 18 is aligned with a rebar 14. It shall also be noted that the blocks may be assembled such that a side wall of one block is disposed in a complementary and contacting manner with a side wall of adjacently disposed block where the thick side of one block is mated with the thin side of another. In another configuration not shown, the blocks 2 may be assembled on the rebars 14 by aligning the channels 18 of the blocks in a similar manner, resulting in an assembly having a curved configuration as the thick side of one block is stacked atop the thick side of another block. In one embodiment, each of the two channels 18 includes an opening having an outward taper 40 of from about 1 degree to about 5 degrees on each wall of the two channels. Such tapers promote mold release and ease rebar installation while not compromising the strength of the block as each channel still contains sufficient materials for a snug fit of the block around a rebar.

Figure 8:
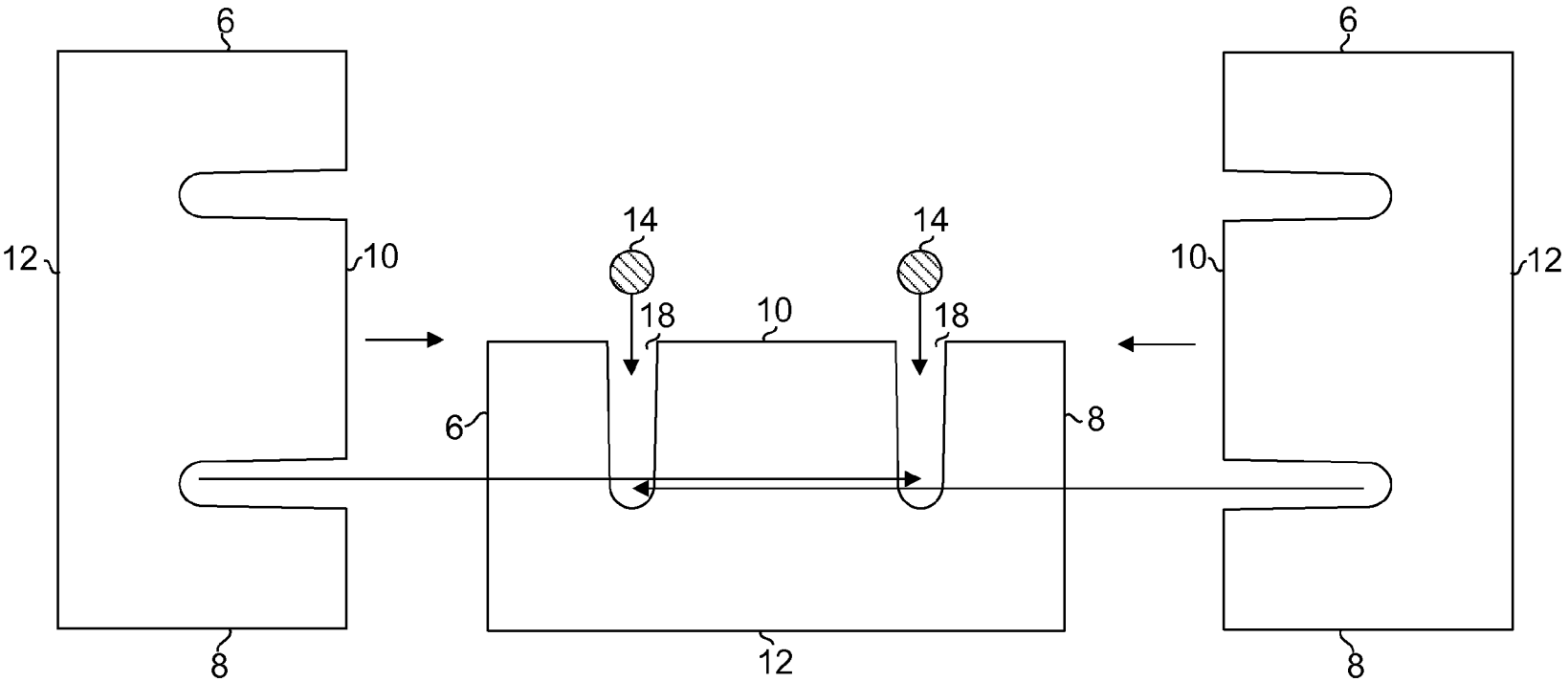
FIG. 8 is a diagram depicting a process of assembling three blocks onto two rebars.
Figure 9:
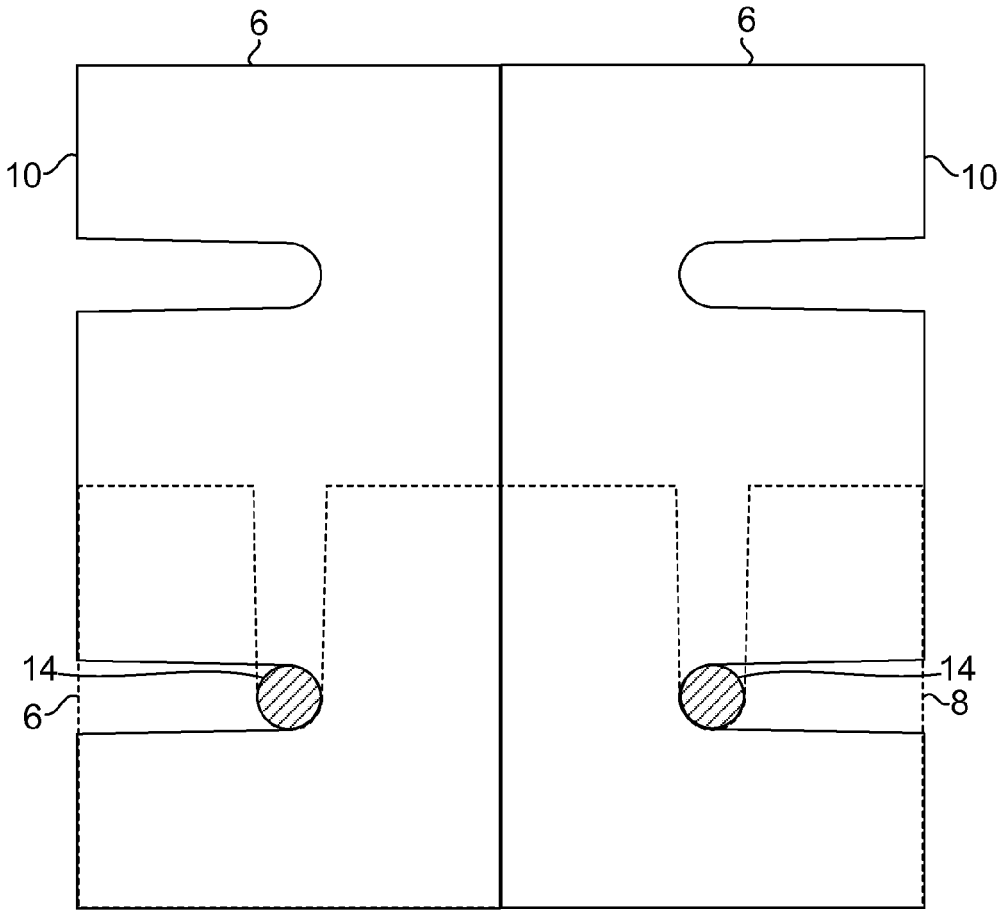
FIG. 9 is a diagram depicting the result of having assembled three blocks onto two rebars.
Figure 10:
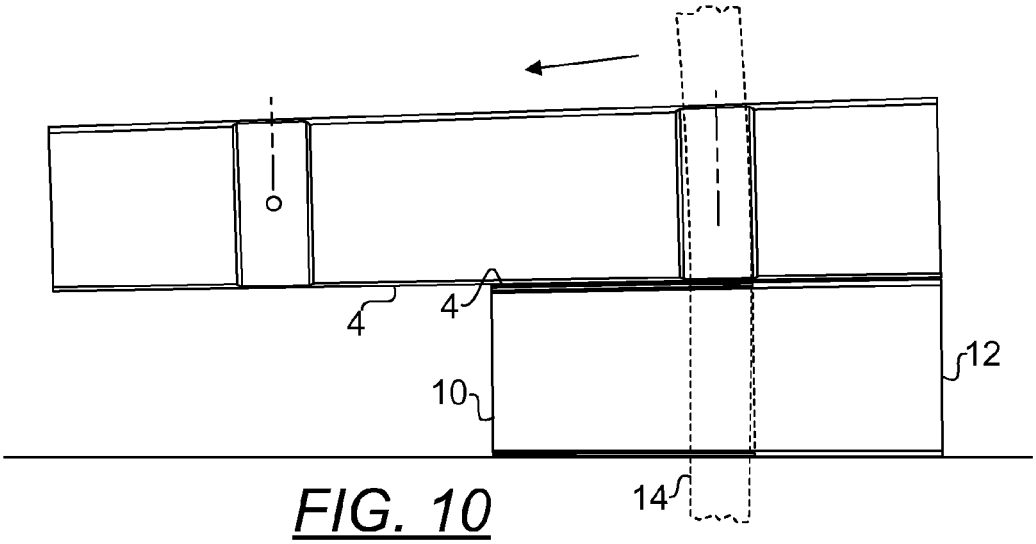
FIG. 10 is another view of the assembled blocks on rebars of FIG. 9.

FIG. 8 is a diagram depicting another process of assembling three blocks onto two rebars. FIG. 9 is a diagram depicting the result of having assembled three blocks onto two rebars. FIG. 10 is another view of the assembled blocks on rebars of FIG. 9. Again, the obscured block or rebars are represented by dotted lines. In this embodiment, at least one side wall 4 is configured to be positionable so as to mate with a side wall 4 of an adjacently disposed block to result in an assembly having a curving trend toward the direction of the arrow. It shall be noted that the blocks are installed on rebars 14 from any one of the two directions, provided that each channel 18 is aligned with a rebar 14. In this example, only one of the two channels of a top block is engaged with a rebar 14. It shall be noted that the blocks 2 may be assembled on the rebars 14, resulting in an assembly having a curved configuration and the blocks being interlocked. In order to remove a top block, one of the top blocks must be lifted and removed to clear its abutting top block. FIGS. 6-10 are used to demonstrate the concepts of assembling blocks, each having a thick side and a thin side and two channels although such assemblies may not have practical uses. In addition, it shall also be appreciated from FIGS. 6-10 that adjacent blocks may generally be stacked perpendicularly or in line.

Figure 11:
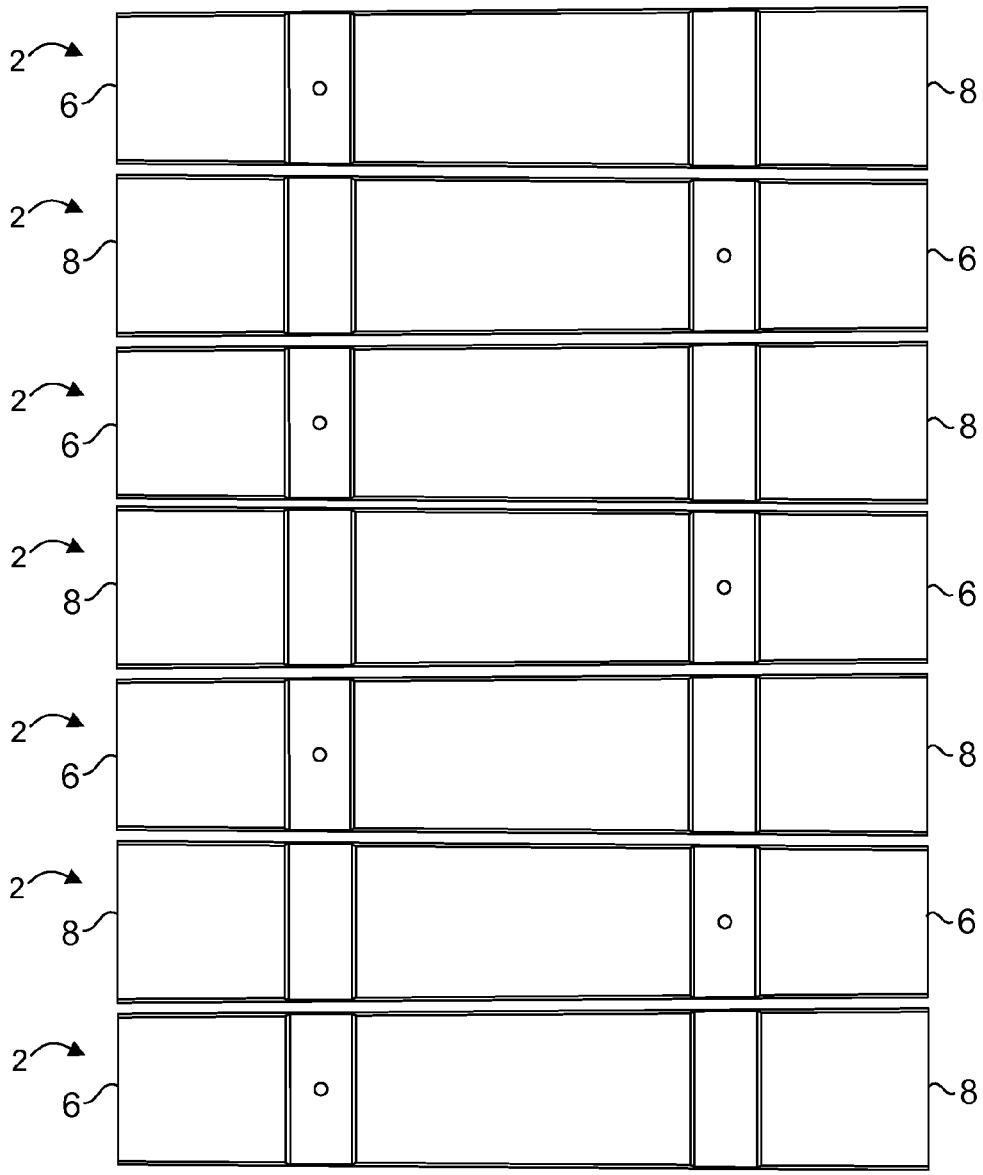
FIG. 11 is a diagram depicting a plurality of blocks arranged such that at least one side wall of a block complements a side wall of an adjacent block in the longitudinal direction only.

FIG. 11 is a diagram depicting a plurality of blocks 2 arranged such that at least one side wall of a block complements a side wall of an adjacent block in the longitudinal direction only. Such arrangement enables seven such blocks to be moved on a pallet of a conventional manufacturing line. In a block manufacturing process, it is critical to form blocks having their high-strength axis aligned in a load bearing direction. Materials, e.g., concrete, is an anisotropic material. It has a higher compressive strength in the axis of compaction as blocks are made. Conventional concrete blocks are assembled in a wall with the high-strength axis oriented in the vertical direction. As the lower strength axis is oriented horizontally, i.e., the direction in which environmental forces are most prevalent, the resulting structure is weaker and prone to failure from horizontal impacts and stresses such as those encountered in tornadoes, hurricanes, tsunamis, earthquakes and other extreme loading scenarios. Conversely, the present blocks used for constructing structures are arranged in a manner where the high-strength axis of each block is oriented in the direction substantially parallel to the direction in which environmental forces are prevalent. In constructing a present block, raw material is first placed within a mold cavity. A "shoe," configured in the external shape of the present block including such features as channels, is then applied atop the raw material, compacting and consolidating the raw material, thereby forming a block having a high-strength axis in the direction in which the compacting action is applied.

Figure 12:
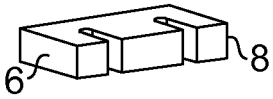
FIG. 12 is a top perspective view depicting one block having been laid down in anticipation of subsequent addition of additional blocks.
Figure 13:
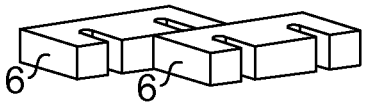
FIG. 13 is a top perspective view depicting one additional block having been laid down in addition to the first block shown in FIG. 12.
Figure 14:
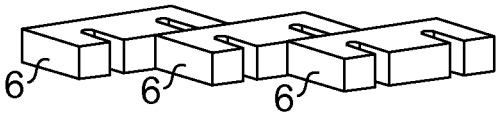
FIG. 14 is a top perspective view depicting one additional block having been laid down in addition to the first and second blocks shown in FIG. 13.
Figure 15:
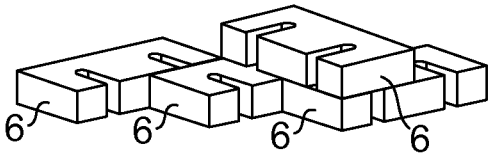
FIG. 15 is a top perspective view depicting one additional block having been laid down in addition to the first, second and third blocks shown in FIG. 14.
Figure 16:
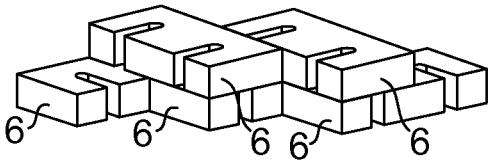
FIG. 16 is a top perspective view depicting one additional block having been laid down in addition to the blocks shown in FIG. 15.
Figure 17:
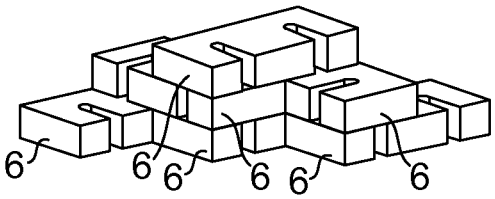
FIG. 17 is a top perspective view depicting one additional block having been laid down in addition to the blocks shown in FIG. 16.
Figure 18:
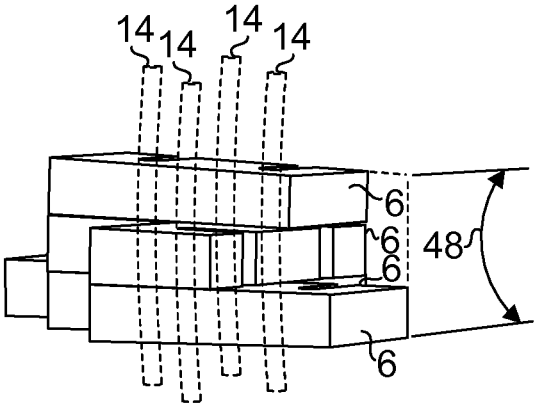
FIG. 18 is another view of the blocks of FIG. 17 shown installed around four rebars and the general trend of the resultant block assembly curving towards one direction.

FIGS. 12-18 depict a series of steps in which a basic block assembly is built. FIG. 12 is a top perspective view depicting one block having been laid down in anticipation of subsequent addition of additional blocks. FIG. 13 is a top perspective view depicting one additional block having been laid down in addition to the first block shown in FIG. 12. The second block is aligned generally in the same direction as the first block and placed with its bottom wall abutting the rear half of the top wall of the first block. FIG. 14 is a top perspective view depicting one additional block having been laid down in addition to the first and second blocks shown in FIG. 13. Again, the third block is aligned generally in the same direction as the first or second block and placed with its bottom wall abutting the rear half of the top wall of the second block. FIG. 15 is a top perspective view depicting one additional block having been laid down in addition to the first, second and third blocks shown in FIG. 14. The fourth block is orientated such that its top wall is facing the same direction as the front terminal walls of the two blocks upon which the fourth block is disposed and disposed atop the abutting halves of their side walls. FIG. 16 is a top perspective view depicting one additional block having been laid down in addition to the blocks shown in FIG. 15. The fifth block is orientated such that its top wall is facing the same direction as the front terminal walls of the two blocks upon which the fifth block is disposed and disposed atop the abutting halves of their side walls. FIG. 17 is a top perspective view depicting one additional block having been laid down in addition to the blocks shown in FIG. 16. The sixth block is orientated in the same orientation as any one of blocks not in the course directly below it but the second course below it. FIG. 18 is another view of the blocks of FIG. 17 shown installed around four rebars 14 and the general trend of the resultant block assembly curving towards one direction as angle 48 is non-zero.

Figure 19:
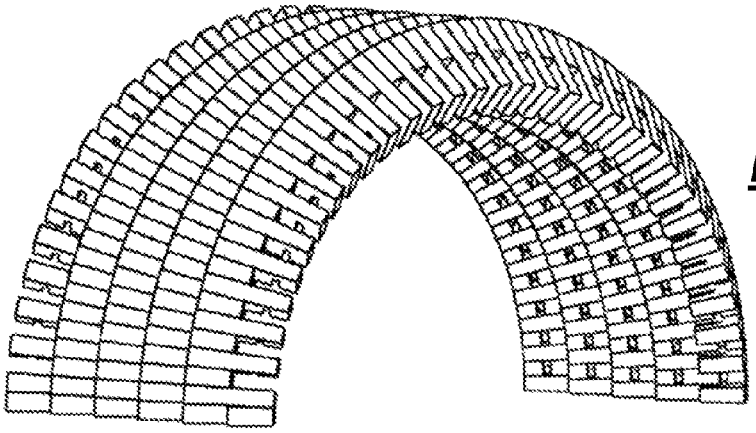
FIG. 19 is a perspective view of a single-wythed arched structure built with a plurality of present blocks.
Figure 20:
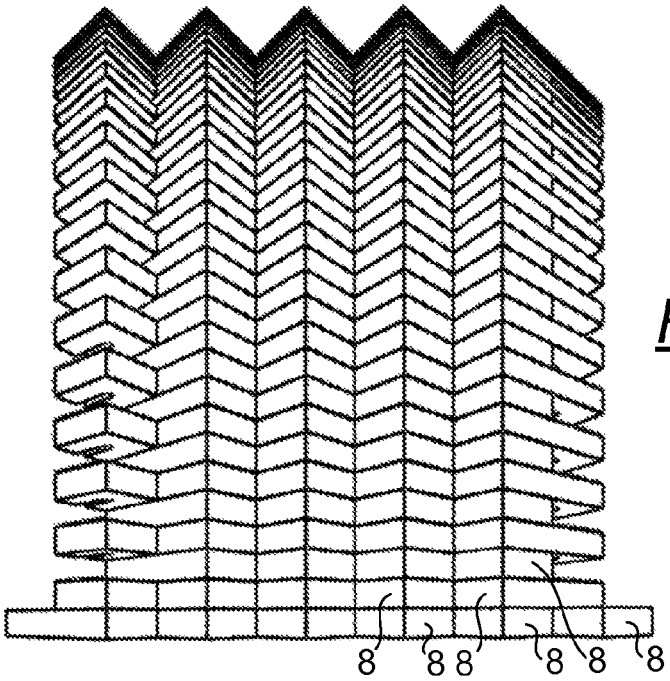
FIG. 20 is a front elevational view of an arched structure built with a plurality of present blocks.
Figure 21:
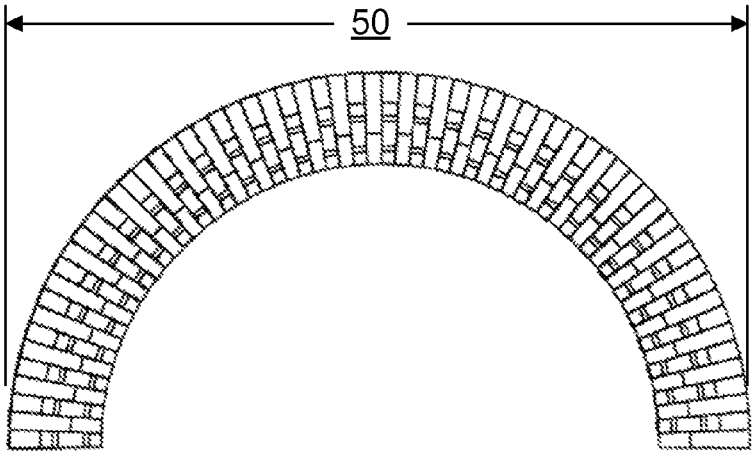
FIG. 21 is a side elevational view of a single-wythed arched structure built with a plurality of present blocks.
Figure 22:
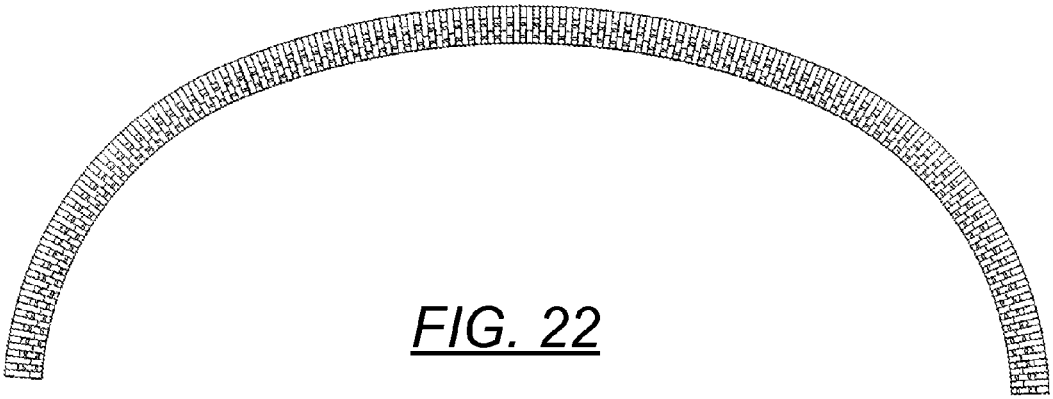
FIG. 22 is a side elevational view of a single-wythed double-centered arch structure built with a plurality of present blocks.

FIG. 19 is a perspective view of a single-wythed arched structure built with a plurality of present blocks. FIG. 20 is a front elevational view of an arched structure built with a plurality of present blocks. It shall be noted that the arched structure is a composite of basic assemblies depicted in FIG. 18. FIG. 21 is a single-wythed side elevational view of an arched structure built with a plurality of present blocks. FIG. 22 is a side elevational view of a single-wythed double-centered arch structure built with a plurality of present blocks. Arch structures of various spans may be constructed from blocks having different block dimensions.

Figure 23:
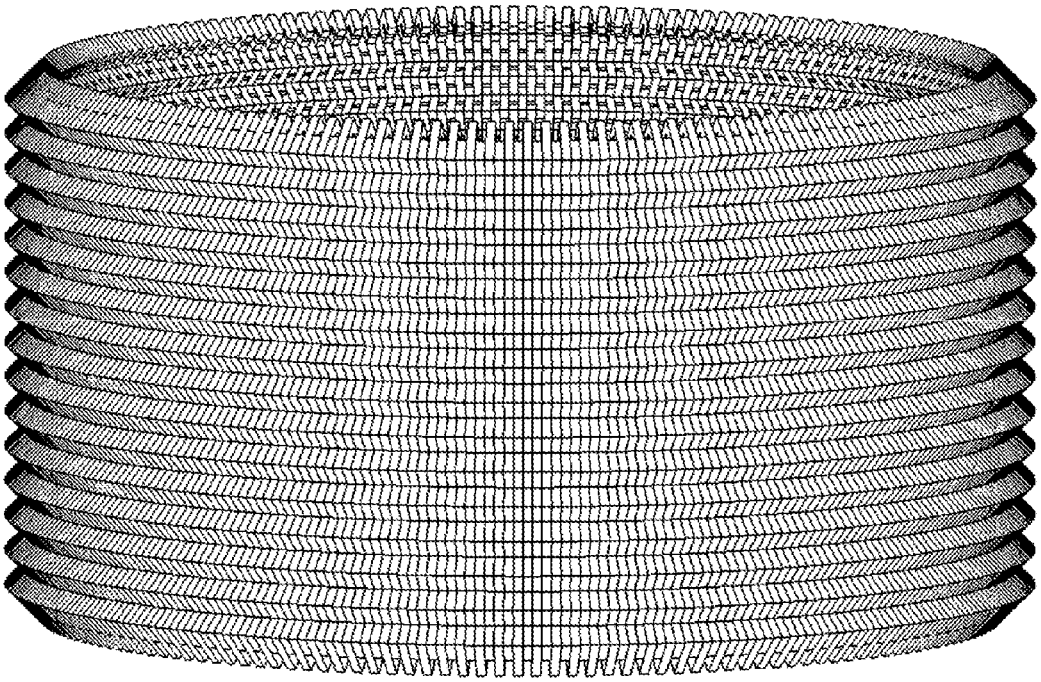
FIG. 23 is a perspective view of a single-wythed cylindrical structure built with a plurality of present blocks.
Figure 24:
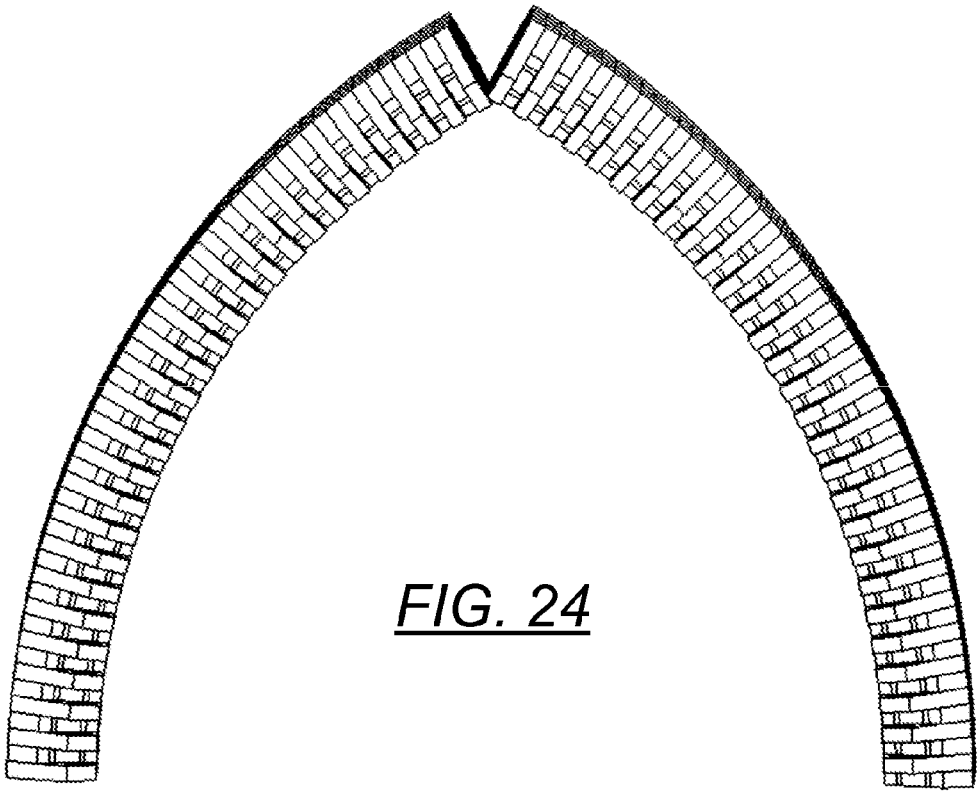
FIG. 24 is a side elevational view of another arched structure built with a plurality of present blocks.

FIG. 23 is a perspective view of a single-wythed cylindrical structure built with a plurality of present blocks. FIG. 24 is a side elevational view of another single-wythed arched structure built with a plurality of present blocks. In this example, a vesica piscis or gothic arch is depicted. It shall be noted therefore that a plurality of the present blocks can be used to form various arches, thereby providing extensive design flexibility. The blocks used to build cylinders and arches are assembled in a manner that creates corrugations or ribs in the assembled cylinder or arch, resulting in greater flexural rigidity, overall strength and lower weight. An arch configured with corrugations or ribs, is much stronger and has greater resistance to external loading, impacts, high winds, seismic forces, etc. per unit weight.

Figure 25:
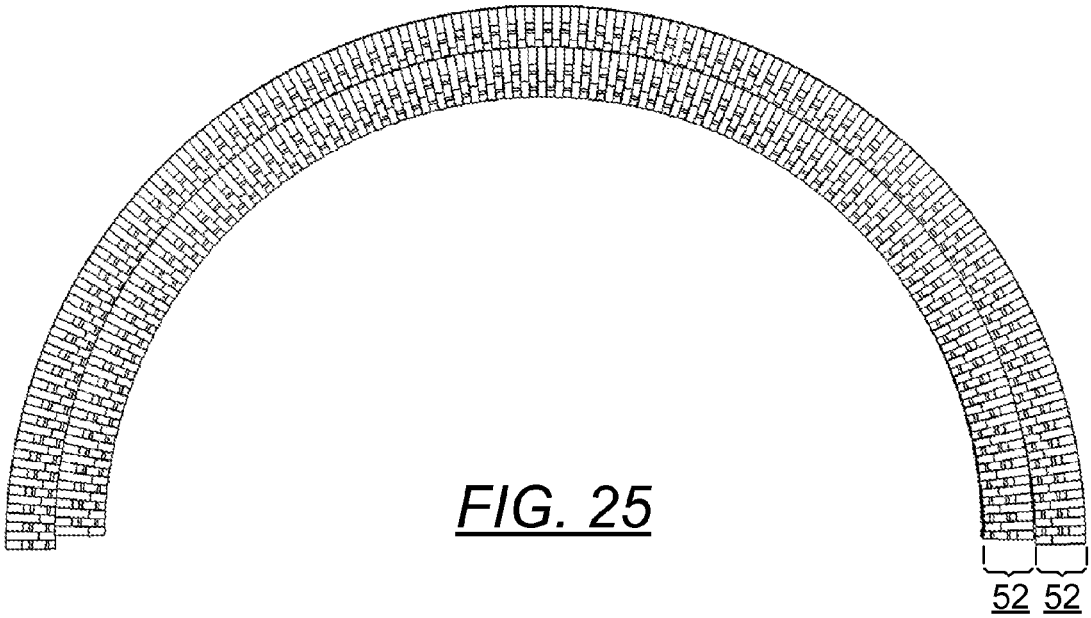
FIG. 25 is a side elevational view of another arched structure built with a plurality of present blocks, depicting a double wythe configuration.

FIG. 25 is a side elevational view of another arched structure built with a plurality of present blocks, depicting a double wythe 52 configuration. Arches or any size can be built with these blocks as construction using blocks is scalable. An arch twice as large as a structure constructed with a single wythe requires walls twice as thick, i.e., another wythe is required to create a wall twice as thick. If an additional wythe is used, a wall three times as thick or an arch that is three times larger than the single wythe arch can be created. This feature adds to the design flexibility of the present block by allowing any size structure to be built.

Figure 26:
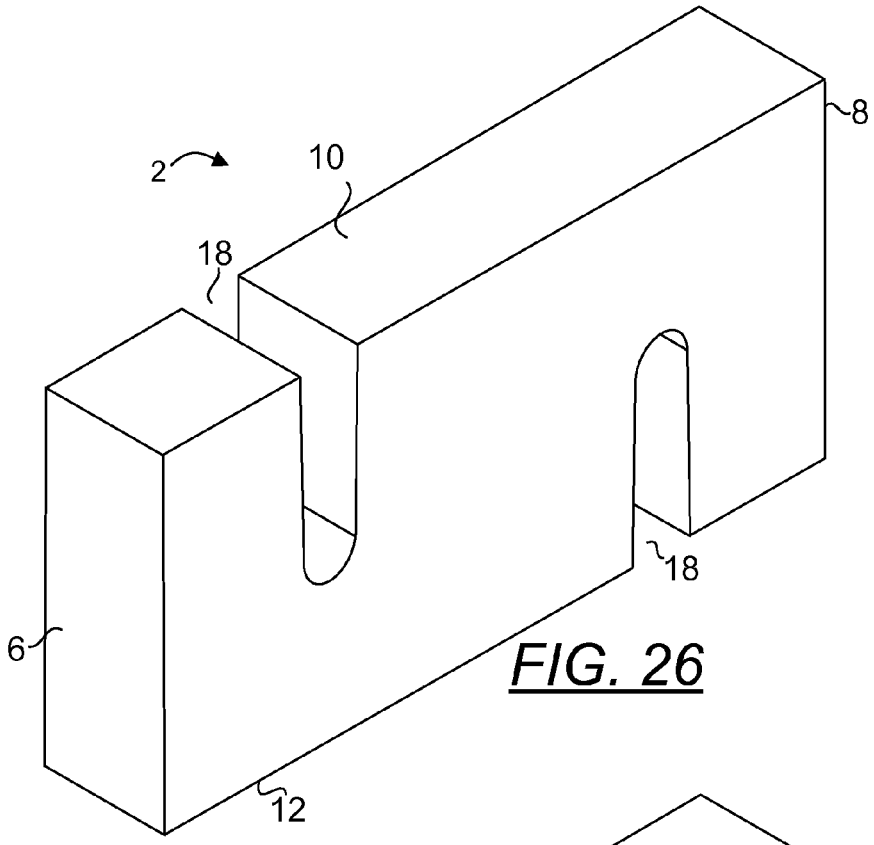
FIG. 26 depicts a block having a channel opening on the top wall and a channel opening on the bottom wall.
Figure 27:
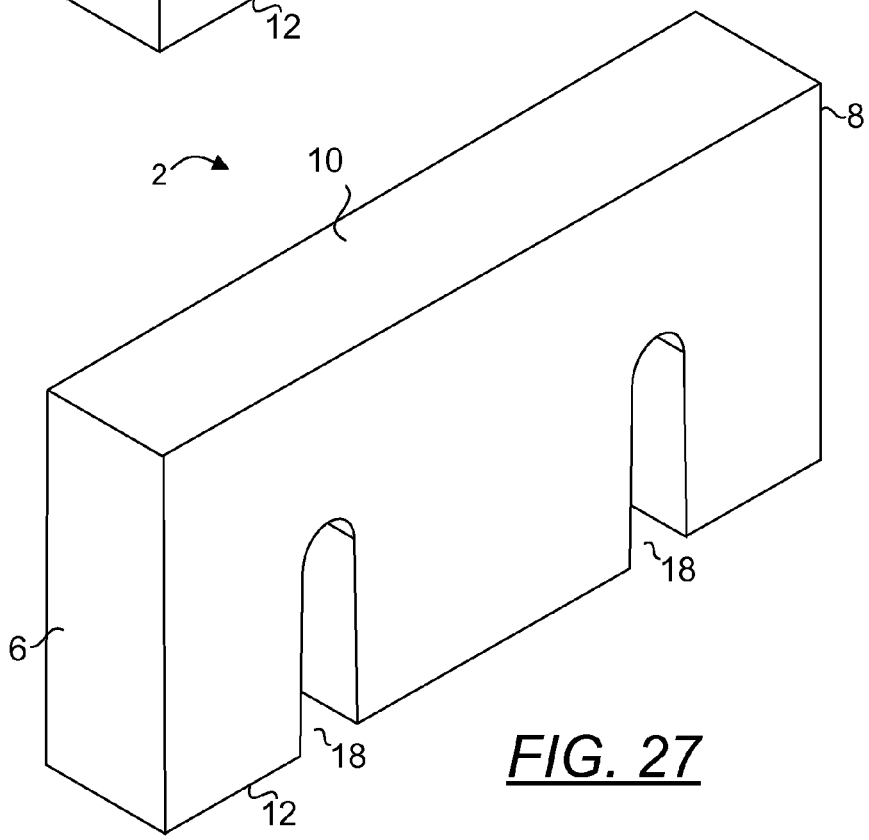
FIG. 27 depicts a block having two channels with their openings disposed the bottom wall.
Figure 28:
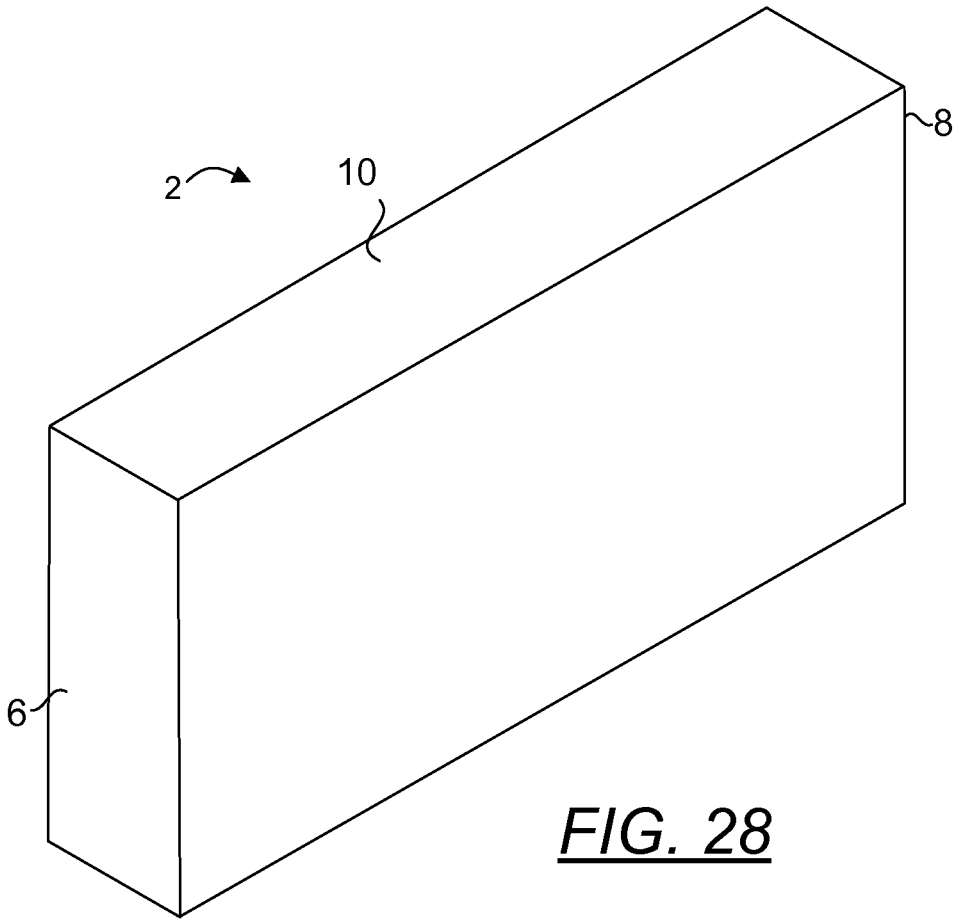
FIG. 28 depicts a block having no channels.

FIG. 26 depicts a block having a channel opening on the top wall 10 and a channel opening on the bottom wall 12. In this embodiment, the center of each channel 18 is unchanged when compared to the channels 18 shown in FIG. 1. In constructing structures from a plurality of the present blocks, as the rebars are typically laid down prior to the assembly of the blocks, there may be instances where such configuration will ease the assembly due to the location of the openings of the channels 18. FIG. 27 depicts a block having two channels with their openings disposed on the bottom wall 12. In this embodiment, as the channels 18 are disposed with their openings on the bottom wall 12, the channels 18 are formed on more prominent portions of the block, i.e., bottom of the block, thereby decreasing the amount of material used in forming the block if compared to a block shown in FIG. 1. The use of less material does not affect the integrity of the block when compared to the block shown in FIG. 1 as the channels are formed on the more prominent portions of the block, i.e., portions with larger wall areas. However, in certain manufacturing processes, this configuration may not be preferable as core pullers may be required to remove materials to form the channels in contrast to forming channels from molds, without having an additional step of removing material from an already formed block. FIG. 28 depicts a block 2 having no channels 18. In this embodiment, no rebars may be used to engage this block directly. However, with the aid of mortar and suitable scaffolding, curvilinear structures may be constructed from a plurality of such blocks.

Suitable materials for constructing the present block include, but not limited to, concrete, cinders, vitrified ceramic, glass, plastic, wood pulp, cardboard, fiberglass, epoxy composite, metal, construction foam, tamped earth, boron, borides, and any combinations thereof. The decision to select a material lies in such factors as the manufacturing costs, material costs, ease of construction, availability of materials, ease of use of the resultant blocks, required strength of the resultant blocks, maintenance requirement of the resultant blocks, etc.

Figure 29:
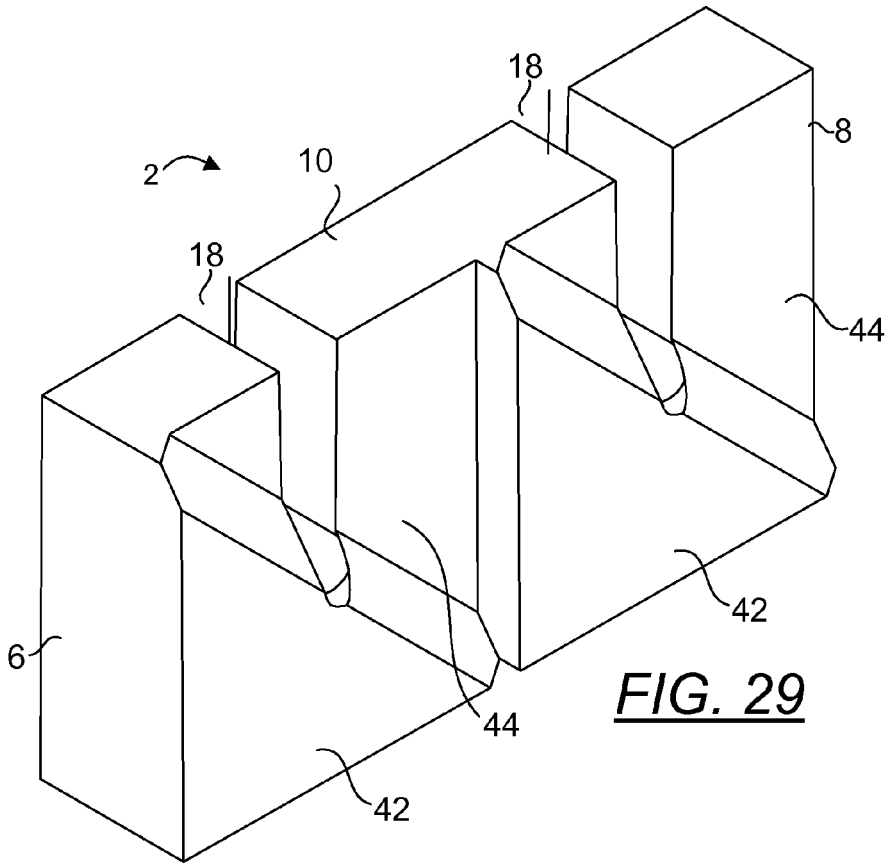
FIG. 29 is a top front perspective view of a block having protrusions and depressions useful for creating interlocks of multiple blocks.
Figure 30:
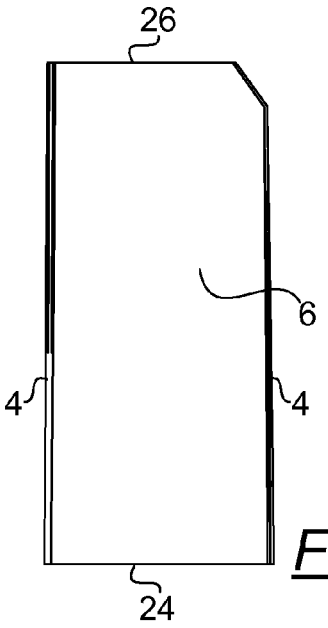
FIG. 30 is a front elevational view of a block of FIG. 29.
Figure 31:
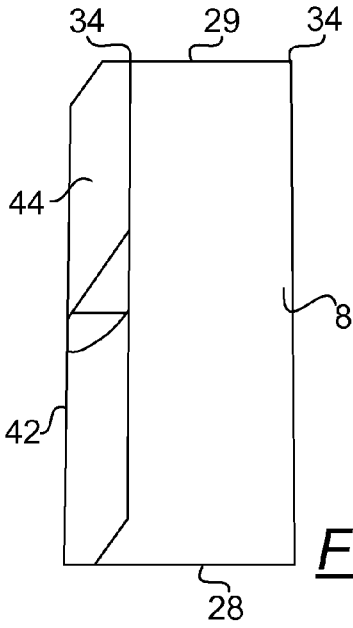
FIG. 31 is a rear elevational view of a block of FIG. 29.
Figure 32:
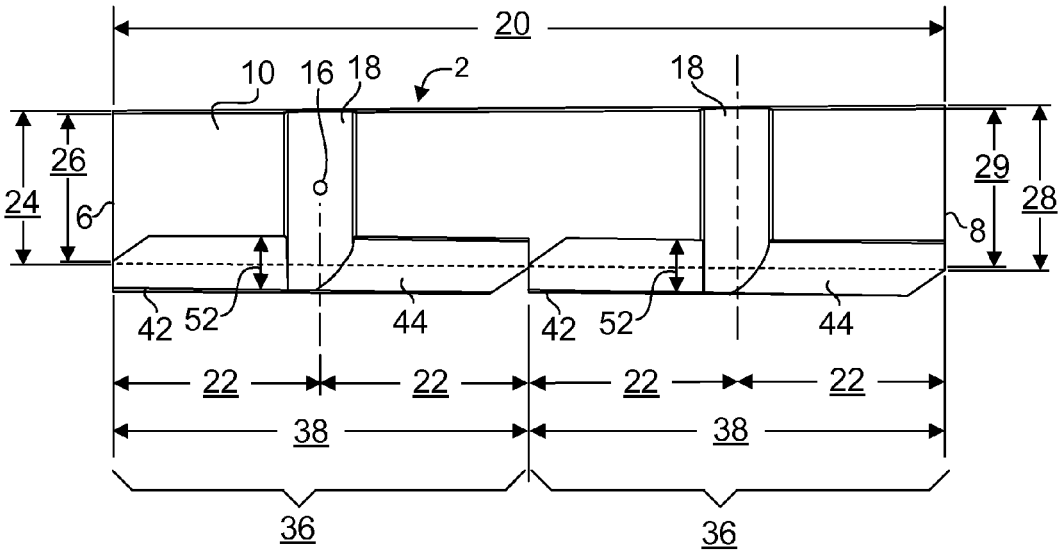
FIG. 32 is a plan view of a block of FIG. 29.
Figure 33:
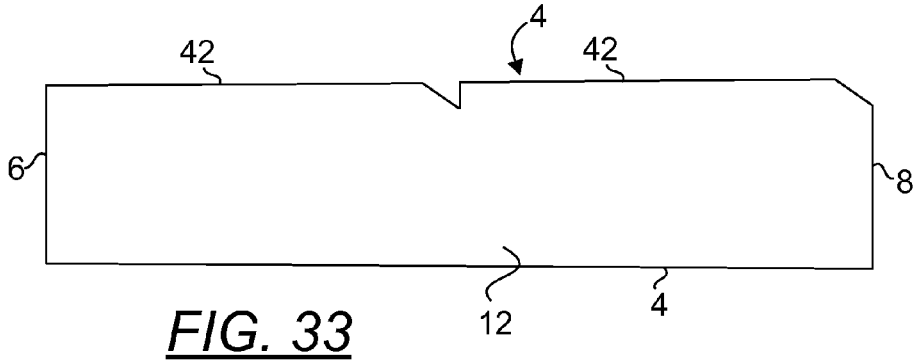
FIG. 33 is a bottom view of a block of FIG. 29.
Figure 34:
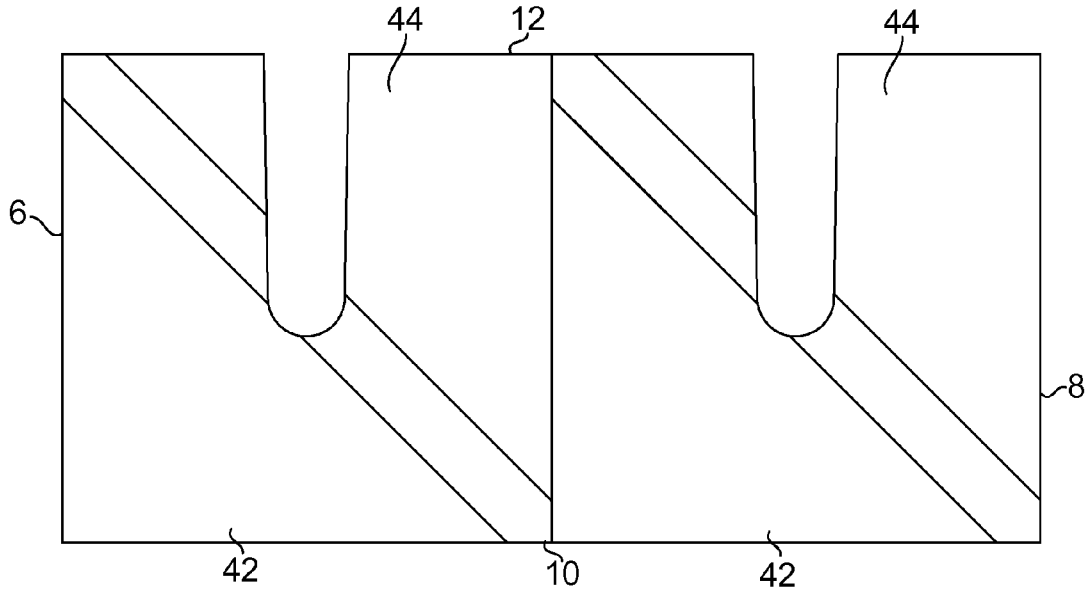
FIG. 34 is a side elevational view of a block of FIG. 29.
Figure 35:
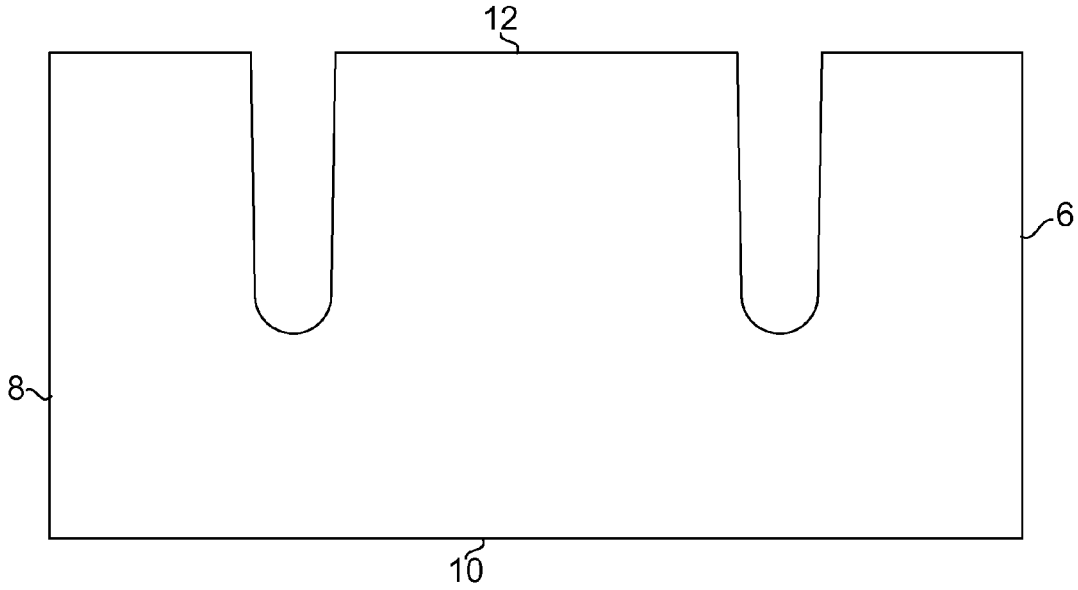
FIG. 35 is a side elevational view of a block of FIG. 29.

FIG. 29 is a top front perspective view of a block having protrusions and depressions useful for creating interlocks of multiple blocks. FIG. 30 is a front elevational view of a block of FIG. 29. FIG. 31 is a rear elevational view of a block of FIG. 29. FIG. 32 is a plan view of a block of FIG. 29. FIG. 33 is a bottom view of a block of FIG. 29. FIG. 34 is a side elevational view of a block of FIG. 29. FIG. 35 is a side elevational view of a block of FIG. 29. Each side wall further includes two halves, one of which is adjacent the front terminal wall 6 and the other of which is adjacent the rear terminal wall 8. In this embodiment, each half includes a depression and a protrusion where the depression 44 is configured in a shape complementary to a protrusion 42 on an abutting block. In one embodiment, the depth 52 of a depression 44 or the height 52 of the protrusion is about 1 inch.

Figure 36:
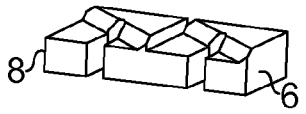
FIG. 36 is a top perspective view depicting one block having been laid down in anticipation of subsequent addition of additional blocks.
Figure 37:
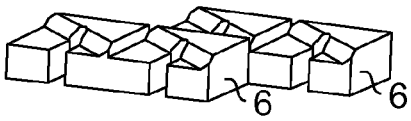
FIG. 37 is a top perspective view depicting one additional block having been laid down in addition to the first block shown in FIG. 36.
Figure 38:
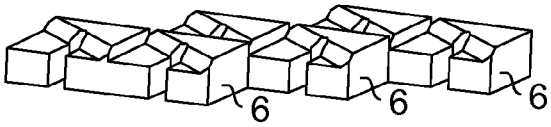
FIG. 38 is a top perspective view depicting one additional block having been laid down in addition to the first and second blocks shown in FIG. 37.
Figure 39:
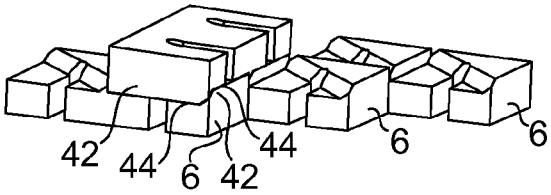
FIG. 39 is a top perspective view depicting one additional block having been laid down in addition to the first, second and third blocks shown in FIG. 38.
Figure 40:
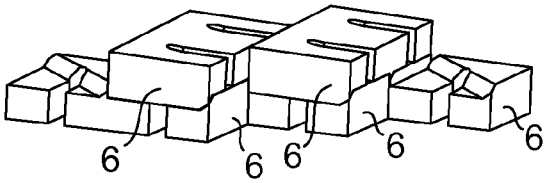
FIG. 40 is a top perspective view depicting one additional block having been laid down in addition to the blocks shown in FIG. 39.

FIGS. 36-42 depict a series of steps in which a basic assembly is built with a plurality of blocks having interlocking features shown in FIG. 29. FIG. 36 is a top perspective view of the one block having been laid down in anticipation of subsequent addition of additional blocks. FIG. 37 is a top perspective view of the one additional block having been laid down in addition to the first block shown in FIG. 36. The second block is aligned generally in the same direction as the first block and placed with its bottom wall abutting the rear half of the top wall of the first block. FIG. 38 is a top perspective view of the one additional block having been laid down in addition to the first and second blocks shown in FIG. 37. Again, the third block is aligned generally in the same direction as the first or second block and placed with its bottom wall abutting the rear half of the top wall of the second block. FIG. 39 is a top perspective view of one additional block having been laid down in addition to the first, second and third blocks shown in FIG. 38. The fourth block is orientated such that its top wall is facing the same direction as the front terminal walls of the two blocks upon which the fourth block is disposed and disposed atop the abutting halves of their side walls. It shall be noted that when disposed atop one or more blocks, the depression 44 of a block is mated with a protrusion 42 of the block below it. Its protrusion 42 is mated with a depression 44 of the block below it. FIG. 40 is a top perspective view of the one additional block having been laid down in addition to the blocks shown in FIG. 39.

Figure 41:
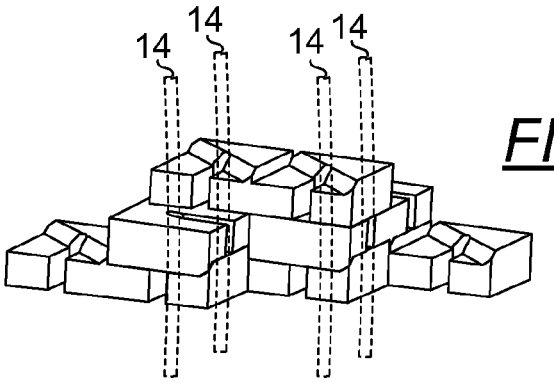
FIG. 41 is a top perspective view depicting one additional block having been laid down in addition to the blocks shown in FIG. 40.
Figure 42:
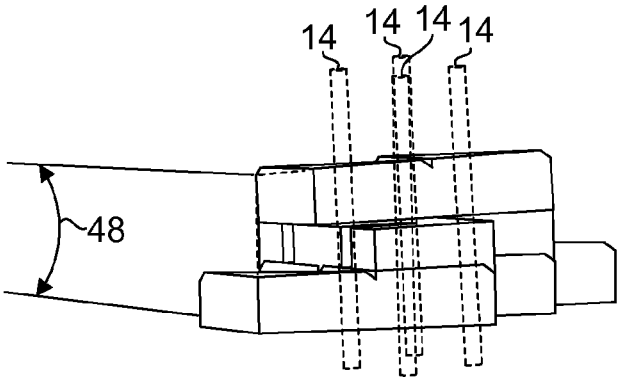
FIG. 42 is another view of the blocks of FIG. 41 shown installed around four rebars and the general trend of the resultant block assembly curving towards one direction.

The fifth block is orientated such that its top wall is facing the same direction as the front terminal walls of the two blocks upon which the fifth block is disposed and disposed atop the abutting halves of their side walls. FIG. 41 is a top perspective view of the one additional block having been laid down in addition to the blocks shown in FIG. 40. The sixth block is orientated in the same orientation as any one of blocks not in the course directly below it but the second course below it. FIG. 42 is another view of the blocks of FIG. 41 shown installed around four rebars 14 and the general trend of the resultant block assembly curving towards one direction as angle 48 is non-zero.

Figure 43:
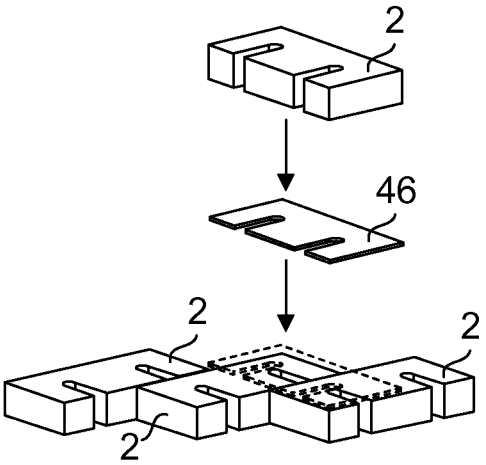
FIG. 43 is a perspective view of an assembly of blocks depicting the use of a gasket in providing a toughened, crack-resistant block assembly.

FIG. 43 is a perspective view of an assembly of blocks depicting the use of a gasket 46 in providing a toughened, crack-resistant block assembly. Structures built with the present blocks can be assembled with or without mortar. Gaskets 46 may also be used between blocks to prevent relative movements between adjacently disposed blocks and to cushion impacts imparted by one block on adjacently disposed blocks. In one embodiment, gaskets shaped according to side walls are used to avoid interferences of gaskets with rebars as such gaskets include suitable openings to accommodate rebars. Suitable materials for gaskets include, but not limited to, rubber and plastic.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. An architectural building block comprising:

(a) a front terminal wall having a top edge and a bottom edge;

(b) a rear terminal wall having a top edge and a bottom edge, said rear terminal wall is disposed substantially parallel to said front terminal wall, wherein both said front terminal wall and said rear terminal wall define the longitudinal ends of said architectural building block, the width of said top edge of said front terminal wall is less than the width of said top edge of said rear terminal wall and the width of said bottom edge of said front terminal wall is less than the width of said bottom edge of said rear terminal wall;

(c) a pair of side walls adjoining said front terminal wall and said rear terminal wall, wherein said pair of side walls lean toward one another and said pair of side walls converge from said rear terminal wall to said front terminal wall; and (d) a top wall and a bottom wall, wherein said bottom wall is disposed substantially parallel to said top wall, and each of said top wall and bottom wall adjoins said front terminal wall, said rear terminal wall and said pair of side walls, wherein at least one said side wall is configured to be positionable so as to mate with a side wall of an adjacently disposed block, whereby curved structures may be constructed from a plurality of such blocks.

2. The architectural building block of claim 1, further comprising two channels, wherein each of said side walls further comprises two halves, each channel extending from one of said side walls to the other one of said side walls, each of said two channels having a width adapted to enable traversal of a rebar and a center having a central axis that is substantially centrally disposed within one of said two halves.

3. The architectural building block of claim 2, wherein each of said two channels comprises an opening having an outward taper of from about 1 degree to about 5 degrees on a wall of said each channel.

4. The architectural building block of claim 2, wherein each of said two channels comprises an opening through said top wall.

5. The architectural building block of claim 2, wherein each of said two channels comprises an opening through said bottom wall.

6. The architectural building block of claim 2, further comprising an orientation marker biasly disposed along the longitudinal direction of said architectural building block.

7. The architectural building block of claim 6, wherein said orientation marker is disposed on a surface of one of said two channels.

8. The architectural building block of claim 1, wherein said architectural building block is constructed from a material selected from the group consisting of concrete, cinders, vitrified ceramic, glass, plastic, wood pulp, cardboard, fiberglass, epoxy composite, metal, construction foam, tamped earth, boron, borides, and combinations thereof.

9. The architectural building block of claim 1, wherein one said side wall further comprises two halves, one adjacent said front terminal wall and another adjacent said rear terminal wall, wherein each half comprises a depression and a protrusion in each of said two halves, wherein said depression is configured in a shape complementary to said protrusion.

10. An architectural building block comprising:

(a) a front terminal wall having a top edge and a bottom edge;

(b) a rear terminal wall having a top edge and a bottom edge, said rear terminal wall is disposed substantially parallel to said front terminal wall, wherein both said front terminal wall and said rear terminal wall define the longitudinal ends of said architectural building block, the width of said to edge of said front terminal wall is less than the width of said to edge of said rear terminal wall and the width of said bottom edge of said front terminal wall is less than the width of said bottom edge of said rear terminal wall;

(c) a pair of side walls adjoining said front terminal wall and said rear terminal wall, wherein said pair of side walls lean toward one another, said pair of side walls converge from said rear terminal wall to said front terminal wall;

(d) a top wall and a bottom, said bottom wall is disposed substantially parallel to said top wall, wherein each of said top wall and bottom wall adjoins said front terminal wall, said rear terminal wall and said pair of side walls; and (e) two channels, wherein each of said side walls further comprises two halves, each channel extending from one of said side walls to the other one of said side walls, each of said two channels having a width adapted to enable traversal of a rebar and a center having a central axis that is substantially centrally disposed within one of said two halves, wherein at least one said side wall is configured to be positionable so as to mate with a side wall of an adjacently disposed block, whereby curved structures may be constructed from a plurality of such blocks.

11. The architectural building block of claim 10, wherein each of said two channels comprises an opening through said top wall.

12. The architectural building block of claim 10, wherein each of said two channels comprises an opening through said bottom wall.

13. The architectural building block of claim 10, wherein each of said two channels comprises an opening having an outward taper of from about 1 degree to about 5 degrees on a wall of said each channel.

14. The architectural building block of claim 10, wherein one said side wall further comprises two halves, one adjacent said front terminal wall and another adjacent said rear terminal wall, wherein each half comprises a depression and a protrusion in each of said two halves, said depression is configured in a shape complementary to said protrusion.

15. The architectural building block of claim 10, further comprising an orientation marker biasly disposed along the longitudinal direction of said architectural building block.

16. The architectural building block of claim 15, wherein said orientation marker is disposed on a surface of one of said two channels.

17. An architectural building block comprising:

(a) a front terminal wall having a top edge and a bottom edge;

(b) a rear terminal wall having a top edge and a bottom edge, said rear terminal wall is disposed substantially parallel to said front terminal wall, wherein both said front terminal wall and said rear terminal wall define the longitudinal ends of said architectural building block, the width of said to edge of said front terminal wall is less than the width of said to edge of said rear terminal wall and the width of said bottom edge of said front terminal wall is less than the width of said bottom edge of said rear terminal wall;

(c) a pair of side walls adjoining said front terminal wall and said rear terminal wall, wherein said pair of side walls lean toward one another, said pair of side walls converge from said rear terminal wall to said front terminal wall and one of said side walls further comprises two halves, one adjacent said front terminal wall and another adjacent said rear terminal wall, wherein each half comprises a depression and a protrusion in each of said two halves, said depression is configured in a shape complementary to said protrusion; and (d) a top wall and a bottom, said bottom wall is disposed substantially parallel to said top wall, wherein each of said top wall and bottom wall adjoins said front terminal wall, said rear terminal wall and said pair of side walls, wherein at least one said side wall is configured to be positionable so as to mate with a side wall of an adjacently disposed block, whereby curved structures may be constructed from a plurality of such blocks.

18. The architectural building block of claim 17, further comprising two channels, wherein each of said side walls further comprises two halves, each channel extending from one of said side walls to the other one of said side walls, each of said two channels having a width adapted to enable traversal of a rebar and a center having a central axis that is substantially centrally disposed within one of said two halves.

19. The architectural building block of claim 18, wherein each of said two channels comprises an opening having an outward taper of from about 1 degree to about 5 degrees on a wall of said each channel.

20. The architectural building block of claim 17, further comprising an orientation marker biasly disposed along the longitudinal direction of said architectural building block, wherein said orientation marker is disposed on a surface of one of said two channels.

* * * * *